US005115822A

United States Patent [19]

Nichols

[11] Patent Number: 5,115,822

[45] Date of Patent: May 26, 1992

[54] DISHWASHER BASKET ASSEMBLY INCLUDING LIFT MECHANISM

[76] Inventor: Will E. Nichols, 250 Cassidy Rd., Bowling Green, Ky. 42101

[21] Appl. No.: 672,451

[22] Filed: Mar. 20, 1991

[51] Int. Cl.[5] ..... B08B 3/02

[52] U.S. Cl. ..... 134/135; 134/137; 134/201; 312/269; 312/312; 211/126

[58] Field of Search ..... 134/135, 200, 137, 164, 134/201, 143, 142; 312/272, 269, 312, 294; 211/126

[56] References Cited

U.S. PATENT DOCUMENTS

| | | | |
|---|---|---|---|
| Re. 22,936 | 11/1947 | Wilson | 134/200 X |
| 1,249,514 | 12/1917 | Scharer | 134/200 UX |
| 1,739,062 | 12/1929 | Connolly | 312/269 Y |
| 1,739,404 | 12/1929 | Lutolf | 134/164 X |
| 1,893,527 | 1/1933 | Shriver | 312/272 X |
| 3,195,969 | 7/1965 | Wallen | 312/269 |
| 3,207,167 | 9/1965 | Edstrom | 134/200 X |
| 3,321,261 | 5/1967 | Guth | 312/269 |
| 3,325,235 | 6/1967 | Pattison et al. | 312/269 |
| 3,376,087 | 4/1968 | Hardy | 312/269 |
| 3,390,930 | 7/1968 | Peterson | 312/272 |
| 3,794,400 | 2/1974 | Guth | 312/272 X |
| 3,801,279 | 4/1974 | Grieco | 134/135 |

FOREIGN PATENT DOCUMENTS

| | | | |
|---|---|---|---|
| 1201019 | 8/1961 | Fed. Rep. of Germany | 312/269 |

*Primary Examiner*—Frankie L. Stinson

[57] ABSTRACT

A dishwasher lower basket assembly including a dish holding basket and a lift mechanism for elevating the basket above the dishwasher door to a position adjacent the upper dish holding basket of the dishwasher.

14 Claims, 3 Drawing Sheets

DISHWASHER BASKET ASSEMBLY INCLUDING LIFT MECHANISM

BACKGROUND OF THE INVENTION

This invention relates to dishwashers. More particularly, the invention relates to a lower basket assembly for use with a dishwasher.

Loading and unloading the lower dish basket of a common dishwasher is not always an easy task especially for the elderly or persons having difficulty bending or otherwise reaching down to the level of the lower basket. Accordingly, it would be desirable to provide for a lower dishwasher basket which provides for easier access.

SUMMARY OF THE INVENTION

The present invention provides for a dishwasher lower basket assembly which includes an extensible and retractable lift so as to position the basket at an elevated position for easier access for loading and unloading.

According to a preferred embodiment of the invention, the dishwasher basket assembly includes a basket mounted on a lift which extends and retracts to selectively position the basket at a lower position adjacent to the inner surface of the dishwasher door when open and in an upper position elevated above the door's surface.

According to an important feature, the lift is adapted to be positioned within the washing compartment of the washer and on the inner surface of the door of the dishwasher.

According to another important feature of the invention, the lift is a sissors-type lift attached to a frame carrying slides or rollers for moving on the dishwasher door surface and on ledges associated with the inner walls of the dishwasher compartment.

According to a further important feature of the invention, the basket is attached to the lift mechanism by way of track means providing for at least limited fore and aft movement of the basket independently of the lift mechanism to provide clearance between the inner end of the lower basket and the upper basket of the dishwasher.

According to a preferred embodiment, the track means connecting the basket to the lift is a pair of dual tracks one on each side of the basket and a pair of rollers or slide members on each side of the basket respectively received in one track of each dual track and ends of upper support arms of the lift received in a second track of each dual track.

According to an important aspect of the preferred embodiment, the end of one of each pair of upper support arms of the lift mechanism that are provided on opposite sides of the basket is pivotably and slidably mounted in the track and the end of the second upper support arm of each pair of lift mechanisms is pivotably mounted to the track at a fixed location. In like manner, an end of one of each pair of lower support arms of the lift mechanism that are provided on opposite sides of the basket is pivotably and slidably mounted in a second track associated with the frame of the assembly and the end of the second lower support arm of each pair of lift mechanisms is pivotably mounted at a fixed location on the frame.

A still further important feature of the invention provides for a latch to hold the lift and basket in at least the elevated position and means for biasing the lift toward the elevated position.

According to a preferred embodiment, the preferred latch includes a pin-in-hole type latch wherein a spring biased latching member carrying stop holes is mounted in the path of travel of the axis of the roller or slide on the end of the upper support arm of the lift which arm carries a pin receivable in the stop holes in at least the extended, elevated position of the lift.

DETAILED DESCRIPTION OF THE PREFERRED EMBODIMENT

Figure 1:
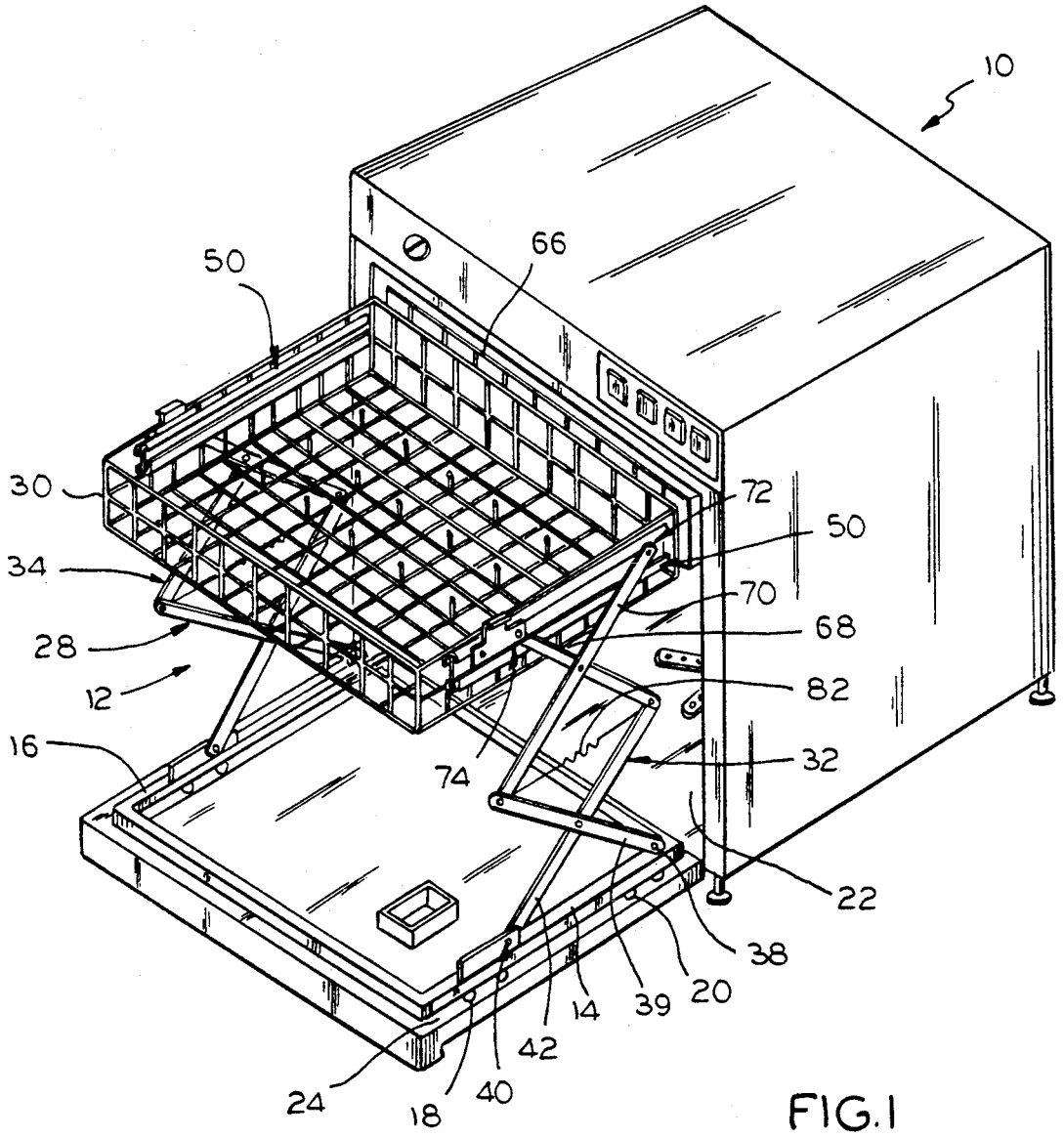
FIG. 1 is a pictorial view of a dishwasher including a lower basket assembly according to the invention.

Shown in FIG. 1, is a dishwasher 10 of conventional structure except for the lower dish holding basket assembly 12 which is contructed according to a preferred embodiment of the invention described below. Advantageously, the lower dish holding basket assembly according to the invention can be constructed by those skilled in the art having the benefit of the description that follows so that the novel basket assembly can be made as a part of a new machine when originally manufactured or as a replacement basket assembly for existing machines.

The basket assembly 12 includes a base frame including at least a pair of side rails 14, 16 each carrying or otherwise providing for attachment of rollers or slides 18, 20 for sliding and positioning the frame and basket attached thereto as described below between a position inside of the washing compartment 22 of the dishwasher and a position disposed externally of the dish washing compartment on an inner surface 24 of the door of the dishwasher when the door is open. Most dishwashers include ledges 26 on inner walls of the washing compartment 22 and the slides or rollers on the base frame are adapted to slide or roll on such ledges. The specific design of the slides or rollers would of course be determined by the specific ledge or support means associated with the dishwasher with which the basket assembly according to the invention is to be used.

Attached to the base frame is a lift mechanism 28 which in the preferred embodiment shown is a sissors type lift mechanism and attached to the lift mechanism is a dishwasher lower dish holding basket 30. The lift 28 is a mechanism including a pair of sissors type lift mechanisms 32, 34, one attached to each side rail 14, 16 of the base frame and to each side of the basket 30. For the following description, reference will be made to only the right side of the assembly, as viewed toward the front of the dishwasher in the drawings, since both sides of the assembly are identical. Each side of the lift is attached to its respective side rail of the base frame by way of one fixed but pivotable attachment 38 at the end of the lower inner support arm 39 of the lift and one pivotable-slidable attachment 40 at the end of the lower outer support arm 42 of the lift. The lower outer pivotable-slidable attachment 40 is achieved by way of a glide, wheel or roller 44 at the end of the lower outer support arm 42 which is received in a track or guide 46 associated with the base frame rail. The length of the track 46 is sized to provide for sufficient horizontal movement of the lower outer support arm to allow the lift to move from a collapsed position whereat the basket is positioned adjacent the inner surface 24 of the door and a fully extended position whereat the basket is positioned elevated above the door and preferably at or substantially at the level of the upper dish holding basket 66 as shown in FIGS. 1 and 2B.

Figure 7:
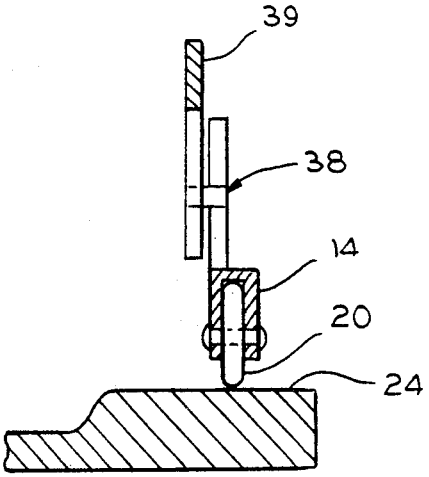
FIG. 7 is a cross sectional view along the line 7—7 in FIG. 2B showing further details of construction.

As shown in FIG. 7, the fixed but pivotable attachment 38 of the end of the lower inner support arm 39 of the lift is achieved by a common pin type hinge arrangement mounted to the rail 14.

Figure 2:
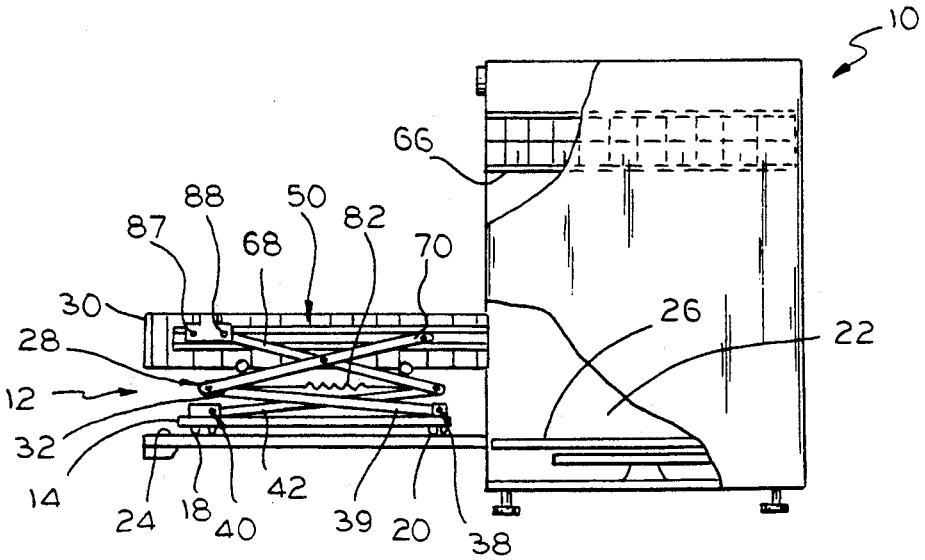
FIG. 2 is a side view of a dishwasher with portions of the dishwasher cut away showing the lift mechanism in the lower most position and the lower basket in the aft, inner most position.
Figure 2A:
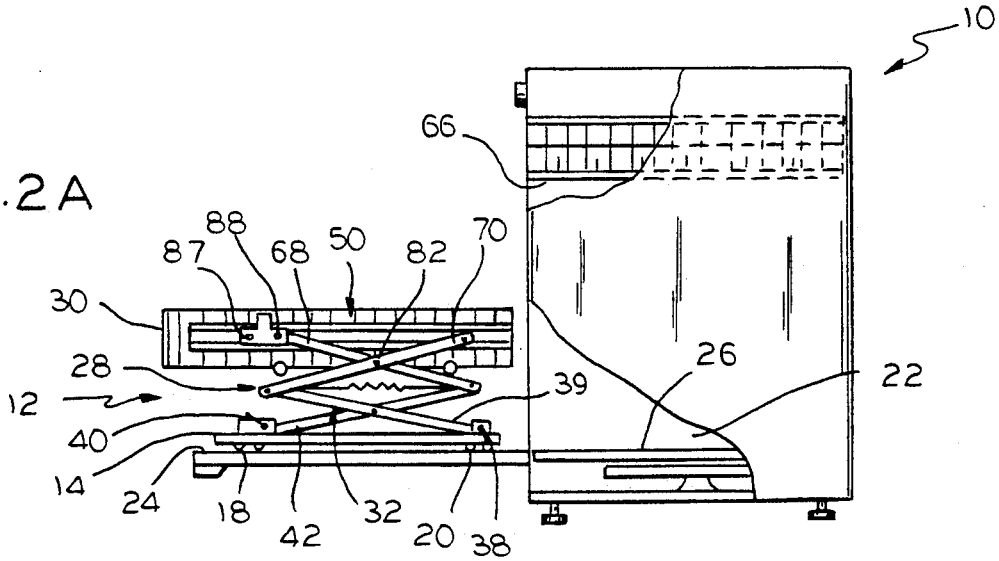
FIG. 2A is a side view of a dishwasher with portions cut away showing the lift mechanism in a collapsed position and the lower basket pulled to the outer most position.
Figure 2B:
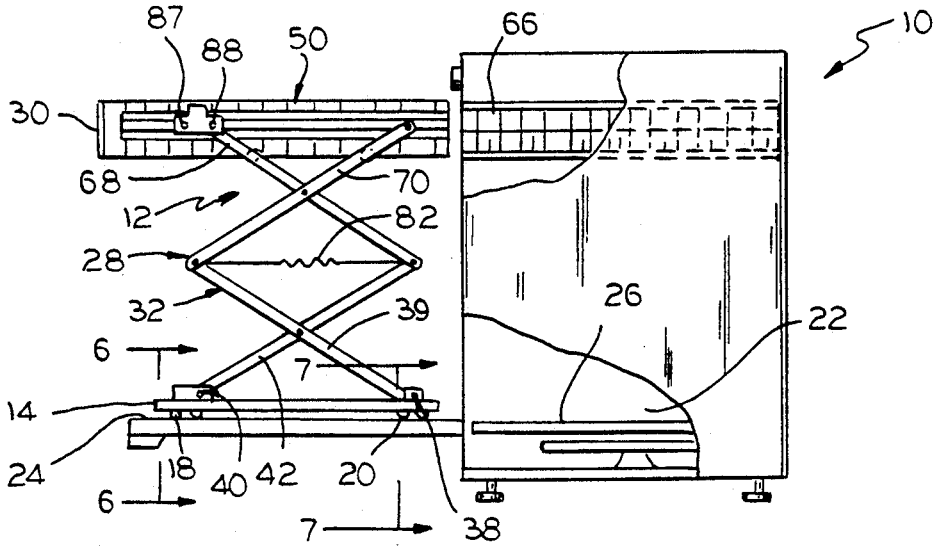
FIG. 2B is a side view of a dishwasher with portions cut away showing the lift mechanism in the extended position and the lower basket in the outer most position located elevated above an inner surface of the dishwasher door.
Figure 3:
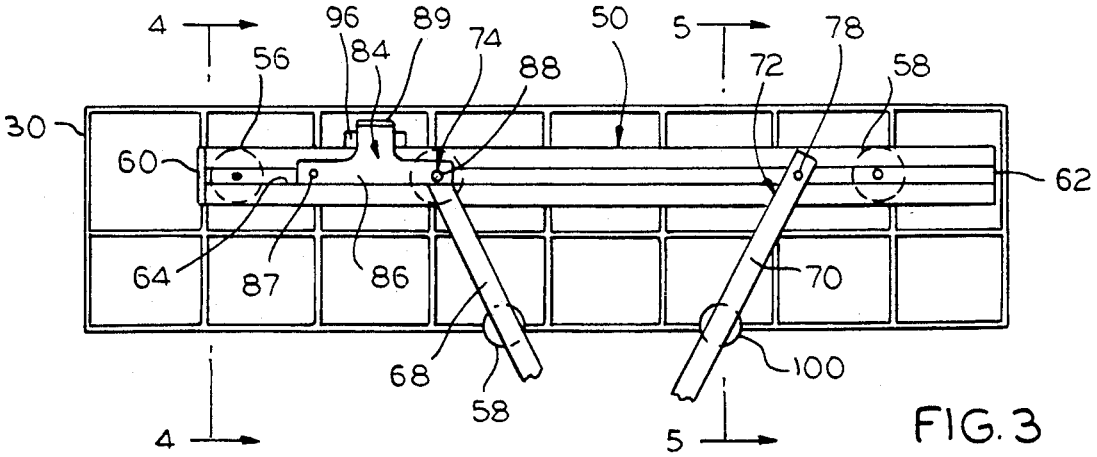
FIG. 3 is a side view of the lower basket assembly showing details of construction.
Figure 4:
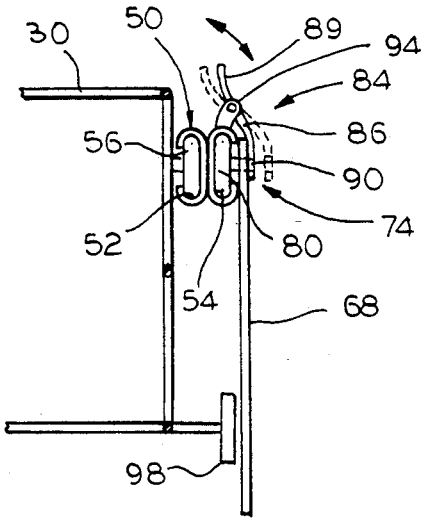
FIG. 4 is a cross sectional view along the line 4—4 in FIG. 3 showing details of construction.
Figure 5:
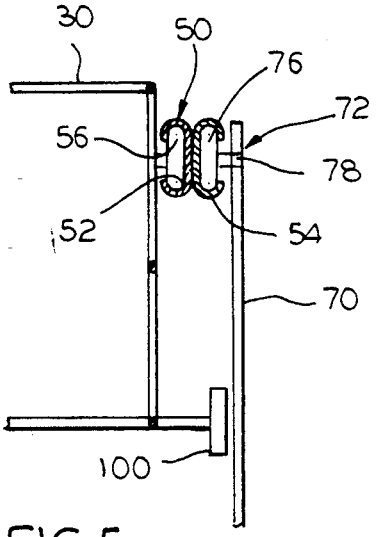
FIG. 5 is a cross sectional view along the line 5—5 in FIG. 3 showing further details of construction.
Figure 6:
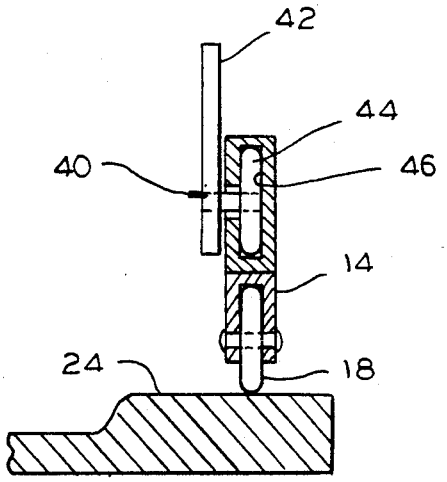
FIG. 6 is a cross sectional view along the line 6—6 in FIG. 2B showing additional details of construction.

Referring to FIGS. 3, 4 and 5, a dual track or guide member extends along substantially the entire length of each side of the basket 30. Each dual track member 50 comprises two side by side tracks or guides 52, 54 an inner one of which has a pair of horizontally spaced apart rollers or slide members 56, 58 extending from each side of the basket slidably received therein. The opposing ends of the inner track 52 are provided with stops 60, 62 which are contacted by the rollers 56, 58 on the basket to limit fore and aft movement of the basket in the track 52. As shown in the drawings, the dual track member 50 is not fixed to the basket but rather, the basket is reciprocally moveable fore and aft in the track 52 to limits as determined by the stops 60, 62 and the positions of the rollers 56, 58 on the sides of the basket. Limited fore and aft (horizontal) movement of the basket independently of the lift and base frame is necessary to provide for clearance between the lower basket 30 and the upper basket 66 so that the lower basket may be lifted from the lower position to the upper position without interference with the upper basket as shown in FIGS 2-2B.

As shown in FIGS. 3, 4 and 5 the ends of the upper support arms 68, 70 of the lift mechanism are attached to the outer, second, track 54 of the dual track member 50 at the basket 30 by way of a pivotable attachment 72 at a fixed location at the upper inner support arm 70 and a pivotable-slidable attachment 74 at the upper outer support arm 68. The fixed pivotable attachment 72 shown includes a block or other member 76 fixed in the second track 54 such as by welding and carrys a pin 78 which pivotably connects the upper inner support arm of the lift to the stationary block. The outer pivotable-slidable attachment 74 is accomplished by way of a roller or slide 80 on the end of the upper outer support arm slidably received in the second track 54. The upper support arm attachments 72, 74 cooperate and function in the same manner as the lower support arm attachments 38, 40 by providing for sufficient horizontal movement of the upper outer support arm to provide for extension and retraction of the lift mechanism between the collapsed and fully extended positions. As noted above, it can be seen that the lower basket 30 is elevated and lowered with the lift mechanism and it is moveable fore and aft, that is toward and away from the front plane of the dishwasher compartment opening, independently of the lift and base frame to the limits provided by the stop members on the inner first track of the dual track at the basket.

As shown in FIGS. 2-2B, the lift mechanism is also provided with a lift assist member since, when fully loaded with dishes, the downward vertical force on the mechanism can be considerable. A preferred assist includes a resilient member such as an extension spring 82 connected between opposite locations of the lift mechanism.

According to the preferred embodiment, the assembly is provided with at least one latch mechanism 84 for holding the lift and basket in at least the elevated position and preferably also in the collapsed position. As shown in FIGS. 3 and 4, a preferred latch includes a resilient, finger operated pivotable latch member 86 mounted on the dual track 50 which includes two holes 87, 88 each located in the path of travel of the axis of the roller or slide 80. One hole, that is the outer hole 87, is located at the outer most position of the axis of the roller or slide 80 when the lift is in the collapsed position as shown in FIGS. 2 and 2A. The inner hole 88 in the latch member is positioned at the inner most position of the axis of the roller or slide 80 when the lift is in the elevated position as shown in FIGS. 1, 2B and 3. The roller or slide 80 on the upper outer support arm is provided with a pin 90 which projects from the axis of the roller or slide and extends through a longitudinal slot 64 of the channel shaped second track 54 and is accordingly captured in one or the other of the holes 87, 88 when aligned therewith depending on the position of the lift. Accordingly, when the lift is elevated as shown in FIGS. 1, 2B and 3, the pin 90 is captured in the inner most hole 88 of the latch and prevents collapse of the lift and, when the lift is collapsed as shown in FIGS. 2 and 2A, the pin 90 is captured in the outer most hole 87 and holds the lift in the collapsed position against the upward bias force of the assist spring 82.

As shown in FIGS. 3 and 4, the latch carries a finger operated tab 89 and is pivotably mounted to the dual track 50 at the basket by way of a pin type hinge attachment 94 having a torsion spring 96 which normally biases the latch toward the latched position to capture and secure the captured pin in the holes.

Lateral stability for the basket particularly when in the elevated position can be increased by providing appropriate bumpers 98, 100 on the sides of the basket at the locations adjacent to the upper support arms 68, 70 of the lift when the lift is in the elevated position as shown in FIGS. 3 and 5.

In use, the lift assembly is normally held in the collapsed state by the latch and the basket is normally in its aft, inner most position with the entire assembly positioned within and supported on the ledges within the washing compartment of the dishwasher. When it is desired to either load or unload the lower basket, the user slides the assembly out of the compartment onto the inner surface of the dishwasher door in conventional manner as shown in FIG. 2. In this position, the lift is collapsed and the basket is positioned adjacent to the inner surface of the door however, as shown in FIG. 2, the rear or inner most end of the basket still protrudes a slight distance into the dishwasher compartment or at least remains partially beneath the upper basket. To provide clearance for lifting the basket, the user pulls the lower basket outwardly away from the plane of the dishwasher opening until the outer roller or slide on the basket contacts and stops against the forward stop member in the basket track. Sufficient movement of the basket is provided to provide the necessary clearance to raise the lift and basket without interference with the upper basket. The user then releases the latch by pivoting the latch member with the finger operated tab and simultaneously pulls the basket upwardly. The spring assists in lifting heavily loaded baskets. At the upper elevated position shown in FIGS. 1 and 2B, the pin on the slide of the upper outer support arm of the lift is captured in the rear hole in the latch and holds the lift and basket in the elevated position. After loading or unloading the basket, the user releases the latch by again pivoting the latch member and lowers the basket and lift to the collapsed position at which the pin on the roller is recaptured in the outer most hole in the latch. As noted, the spring, in addition to assisting in lifting a heavily loaded basket, prevents the lift from suddenly collapsing under the weight of a loaded basket. The spring is also sized to provide for gently lowering or requiring only minimal downward force on a loaded basket in order to collapse the lift. Of course, the spring must not be so strong so as to cause an unloaded or a partially loaded basket to suddenly "pop-up" from the lower position and those skilled in the art can readily size the spring or other assist mechanism to provide proper balance between the forces acting on a loaded, partially loaded or an unloaded basket. Having described the preferred embodiment of the invention, those skilled in the art having the benefit of the description and the accompanying drawings can readily devise other embodiments and modifications which other embodiments and modifications are to be considered to be within the scope of the appended claims.

What is claimed:

1. A lower basket assembly for a dishwasher having individual upper and lower baskets comprising:

a lower basket;

lift means attached to the lower basket adapted to be supported on an inner surface of a door of said dishwasher when in an open position for moving said lower basket between a first position proximate said inner surface with said lift means in a lower most position and a second position elevated above said inner surface with said lift means in an elevated position and said upper basket positioned within a washing compartment of said dishwasher.

2. The lower basket assembly as defined in claim 1 wherein said lift means is a sissors type lift.

3. The lower basket as defined in claim 2 including first track means mounted on opposing sides of said basket, an upper end of said sissors type lift mounted to said first track means, second track means mounted to the lower end of said sissors type lift, said first and second track means providing for extension and retraction of said sissors type lift.

4. The lower basket assembly as defined in claim 3 wherein said first track means includes two pair of tracks, one pair of tracks extending along each of said opposing sides of the lower basket, said basket including two pair of slide members, one pair of slide members being mounting spaced apart on each of the opposing sides of the basket, each pair of slide members on each opposing side received in one of the tracks of said respective pair of tracks, the upper end of said sissor type lift mounted to the second track of each of said pair of tracks.

5. The lower basket assembly as defined in claim 3 wherein said lift means includes latch means for holding said lift means in at least said elevated position.

6. A lower basket assembly for a dishwasher comprising:

a frame including means for moving said frame between a position within said dishwasher and a position external of said dishwasher supported on an inner surface of a door of said dishwasher when in an open horizontal position;

a lower basket for holding dishes; and means for attaching said lower basket to said frame adapted to selectively position said lower basket in a lower position adjacent said inner surface of said door and in a position elevated from said inner surface of said door with said frame positioned on said inner surface of said door.

7. The lower basket assembly as defined in claim 6 wherein said means adapted to selectively position said lower basket in the lower position and said elevated position includes a sissors type lift having ends of two pair of upper support arms attached to track means on said lower basket and ends of two pair of lower support arms attached to said frame.

8. The lower basket assembly as defined in claim 7 wherein the ends of one of said pair of upper support arms is pivotably mounted at a fixed location on said track means on said lower basket, the ends of the second of the pair of the upper support arms is pivotably and slidably mounted to said track means on the lower basket, the ends of one of said pair of lower support arms are pivotably mounted at a fixed location on said frame and the ends of the second of the pair of lower support arms are pivotably and slidably mounted to said frame.

9. The lower basket assembly as defined in claim 8 wherein said lower basket is mounted to said track means for slidable movement.

10. The lower basket assembly as defined in claim 7 further including latch means associated with said lift for releasably holding said lower basket in said elevated position.

11. A lower basket assembly for a dishwasher comprising:

lower basket means for holding dishes; and lift means for selectively moving and positioning said lower basket in a lowermost position and an uppermost position, said lift means including means for moving and supporting said lift means between locations within a washing compartment of the dishwasher and on an inner surface of a door of the dishwasher when in an open substantially horizontal position.

12. The lower basket assembly as defined in claim 11 wherein said means for moving and supporting said lift means includes a frame having roller means for engaging said inner surface of the door and ledge means associated with the washing compartment of the dishwasher, said lift means including a sissors type lift attached to said frame and to said lower basket means, and latch means for releasably holding said lower basket in at least the uppermost position.

13. The lower basket assembly as defined in claim 12 wherein said basket means is mounted to said lift by way of track means providing for limited reciprocal horizontal movement of said lower basket means independently of said frame and lift.

14. The lower basket assembly as defined in claim 13 further including means for biasing said lift in a direction toward the uppermost position of the lower basket means.

* * * * *